US011385027B2

(12) United States Patent
Galli

(10) Patent No.: US 11,385,027 B2
(45) Date of Patent: Jul. 12, 2022

(54) MODULAR DOVETAIL RAIL CLAMPING ASSEMBLY

(71) Applicant: Emissive Energy Corp., North Kingstown, RI (US)

(72) Inventor: Robert D. Galli, North Kingstown, RI (US)

(73) Assignee: Emissive Energy Corp., North Kingstown, RI (US)

( * ) Notice: Subject to any disclaimer, the term of this patent is extended or adjusted under 35 U.S.C. 154(b) by 0 days.

(21) Appl. No.: 17/179,599

(22) Filed: Feb. 19, 2021

(65) Prior Publication Data

US 2021/0172708 A1 Jun. 10, 2021

Related U.S. Application Data

(63) Continuation of application No. 16/848,875, filed on Apr. 15, 2020, now Pat. No. 10,942,009, which is a continuation-in-part of application No. 16/430,062, filed on Jun. 3, 2019, now Pat. No. 10,648,776, which is a continuation of application No. 15/828,469, filed on Dec. 1, 2017, now Pat. No. 10,352,657, which is a continuation of application No. 15/273,835, filed on Sep. 23, 2016, now Pat. No. 9,841,258.

(51) Int. Cl.
*F41G 11/00* (2006.01)
*F41G 1/35* (2006.01)

(52) U.S. Cl.
CPC ..... *F41G 11/003* (2013.01); *F41G 1/35* (2013.01)

(58) Field of Classification Search
CPC ..... F41G 11/003; F41G 11/001; F41G 1/35
USPC ..... 42/124, 127
See application file for complete search history.

(56) References Cited

U.S. PATENT DOCUMENTS

| | | | |
|---|---|---|---|
| 7,188,978 | B2 | 3/2007 | Sharrah et al. |
| 8,287,157 | B2 | 10/2012 | Sharrah et al. |
| 9,551,550 | B2 | 1/2017 | Wells |
| 9,841,258 | B1 | 12/2017 | Galli et al. |
| 10,352,657 | B2 | 7/2019 | Galli et al. |
| 10,648,776 | B2 | 5/2020 | Galli et al. |
| 2013/0148367 | A1 | 6/2013 | Sharrah et al. |
| 2015/0124436 | A1 | 5/2015 | Galli et al. |
| 2015/0159847 | A1 | 6/2015 | Galli et al. |

FOREIGN PATENT DOCUMENTS

| | | | |
|---|---|---|---|
| RU | 2521853 | C1 | 7/2014 |

*Primary Examiner* — Reginald S Tillman, Jr.
(74) *Attorney, Agent, or Firm* — Barlow, Josephs & Holmes, Ltd.; Stephen J. Holmes

(57) ABSTRACT

A flashlight assembly includes an elongated flashlight body having a fixed clamp component. A movable clamp component opposes the fixed clamp. A threaded clamping fastener extends through the movable clamp component and into the body to draw the movable clamp component into engagement with the body. A removable, reversible crossbar extends transversely across the body between the fixed clamp component and the movable clamp component in a spline channel. The crossbar has both a universal rail side and a MIL-STD 1913 rail side.

20 Claims, 10 Drawing Sheets

MODULAR DOVETAIL RAIL CLAMPING ASSEMBLY

CROSS-REFERENCE TO RELATED APPLICATIONS

This application is a continuation of U.S. application Ser. No. 16/848,875, filed Apr. 15, 2020, which is a continuation-in-part of U.S. application Ser. No. 16/430,062, filed Jun. 3, 2019, now U.S. patent Ser. No. 10/648,776, issued May 12, 2020, which is a continuation of U.S. application Ser. No. 15/828,469, filed Dec. 1, 2017, now U.S. patent Ser. No. 10/352,657, issued Jul. 16, 2019, which is a continuation of U.S. application Ser. No. 15/273,835, filed Sep. 23, 2016, now U.S. Pat. No. 9,841,258, issued Dec. 12, 2017.

BACKGROUND OF THE INVENTION

(1) Field of the Invention

The instant invention relates to weapon accessories for commercial and combat weapons, and more particularly to dovetail rail clamping assemblies for securing weapon accessories to a weapon.

(2) Description of Related Art

As the field of commercial and combat weaponry expands, numerous add-on accessories have become available and are commonly mounted on various firearms. In order to mount these accessories, most weapons now include, or are modified to include, one or more dovetail attachment rails. Many of the semi-automatic rifle systems include rail systems having four separate rails surrounding the barrel for maximum mounting surface area. Pistols often include a single dovetail rail extending forwardly from the trigger guard below the barrel. The accessories are typically mounted to the dovetail rails using clamping assemblies which are part of a mount or which are incorporated directly into the accessory housing. Many varieties of clamping arrangements are known in the art.

There are two main types of dovetail attachment rails, the Weaver rail (or universal rail) and the newer MIL-STD 1913 rail, both of which have a virtually identical cross-sectional profile. The key difference lies in the placement of the recoil grooves and in the width of the grooves. MIL-STD-1913 grooves are 0.206" wide and have a center-to-center width of 0.394". The placement of these grooves has to be consistent in order for it to be a true MIL-STD system. Weaver (universal) system grooves are 0.180" wide and are not necessarily consistent in a center-to-center measurement from one groove to the next.

As is well known in this art, user configurable mounting arrangements are highly desirable as there are many different types of accessories and many different preferences for their mounting and operation. Sighting accessories are typically mounted on an upper rail. However, electronic accessories, such as flashlights, IR illuminators and lasers can be mounted in many different locations around the barrel. The ability of the user to mount an accessory in a particular location on a weapon is paramount to ease of use, user effectiveness and most importantly, user safety. Customization is critical to every soldier and law enforcement officer.

SUMMARY OF THE INVENTION

The invention relates to dovetail rail mounting systems for removably securing weapon accessories to a dovetail rail. A modular dovetail rail clamping assembly includes a body having a longitudinal axis and a rail engaging surface extending parallel to the longitudinal axis. The body may be formed as a mount for receiving and securing a weapon accessory to the dovetail rail, or the body may be integrated directly into the housing of an accessory, such as a flashlight.

A fixed clamp component has a longitudinal rail groove and a threaded fastener extends transversely through the body and is received into the fixed clamp component to draw the fixed clamp component into firm engagement with the body. The fixed clamp component and the body have longitudinal ridge and groove mating structures which rigidly fix alignment of the fixed clamp component relative to the body when assembled. In the exemplary embodiments, the threaded fastener is permanently fixed in place once the fixed clamp component is assembled with the body.

A movable clamp component opposes the fixed clamp and also has a longitudinal rail groove. A threaded clamping fastener extends transversely through the movable clamp component and the body and is removably received into the fixed clamp component whereby the threaded clamping fastener draws the movable clamp component into engagement with the body. The head of the clamping fastener is exposed on the outer surface of the movable clamp component so that the user may remove the fastener when mounting or unmounting the accessory.

A removable, reversible crossbar extends transversely across the rail engaging surface between the fixed clamp component and the movable clamp component. In this regard, the body includes a crossbar spline channel extending transversely through the body and across the rail engaging surface. The crossbar spline channel has a retaining ridge flush with the rail engaging surface and an angled undercut beneath the retaining ridge. The crossbar is formed so that it can be inserted into the spline in two different orientations. More specifically, the crossbar has a generally rectangular cross-section with a universal rail bar on one side thereof and a wider MIL-STD 1913 rail bar on an opposing side thereof. A retaining groove which mates with the spline channel retaining ridge is formed on a side surface therebetween. The crossbar can be reversibly mounted in the spline channel wherein the crossbar is slidably received in a first orientation within spline channel with the universal rail bar side slidably received in the spline channel and the MIL-STD 1913 rail bar side exposed above the rail engaging surface for engagement with the dovetail rail, and a second orientation with the MIL-STD 1913 rail bar side slidably received in the spline channel and the universal rail bar side exposed above the rail engaging surface for engagement with the dovetail rail.

In another exemplary embodiment, the crossbar spline channel extends only partially inwardly from the fixed clamp component side of the body wherein the crossbar is fully captured between the body and the fixed clamp component. This makes removal of the crossbar more difficult in embodiments where the fixed clamp component is not permanently secured. Moreover, this arrangement provides flexibility in manufacturing to easily provide either of two different dedicated mounting options when the fixed clamp component is secured in place permanently.

In order to provide maximum flexibility in the manufacturing process, the body may be molded from a polymer material. This allows the body to be molded as a custom mount shape, or directly integrated into the housing of an accessory. In other exemplary embodiments, the crossbar may also be formed from a polymer material. However, to also provide maximum strength and fixation on the dovetail rail, the fixed clamp component, the moveable clamp component and the crossbar are preferably formed from a metal, such as aluminum. This hybrid material arrangement provides the best features from both types of materials.

Accordingly, it can be seen that the present disclosure provides a unique and novel clamping assembly for any weapon accessory.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
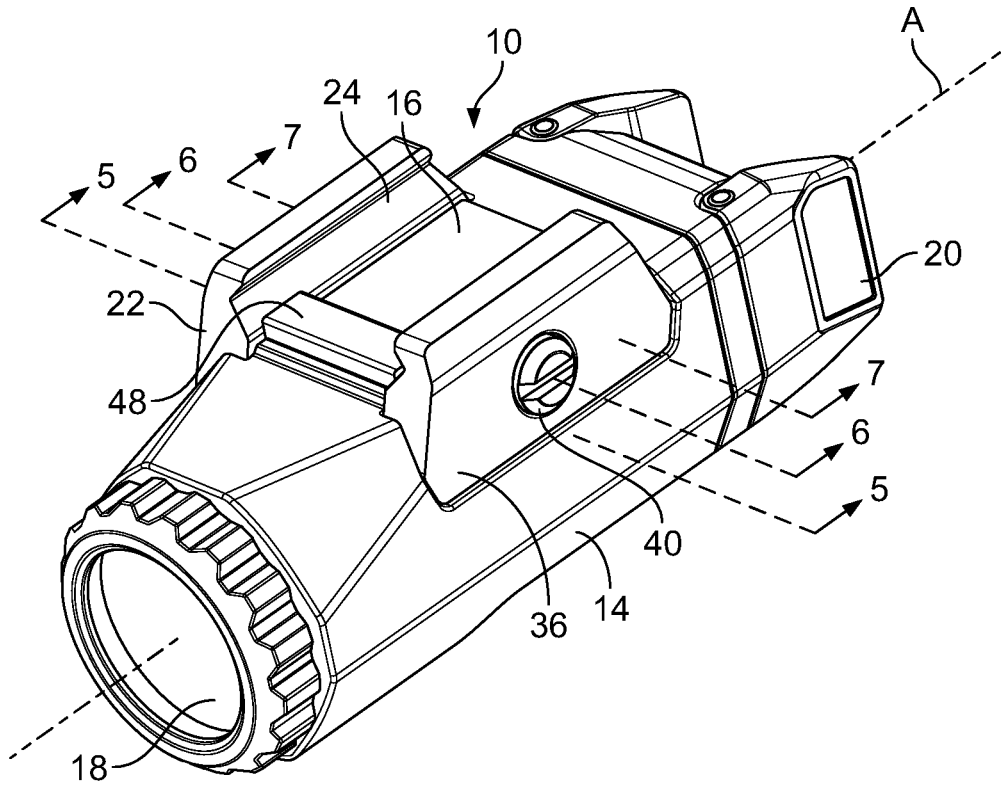
FIG. 1 is a perspective view of a pistol mounted flashlight incorporating the hybrid modular dovetail rail clamping assembly of the present disclosure.
Figure 2:
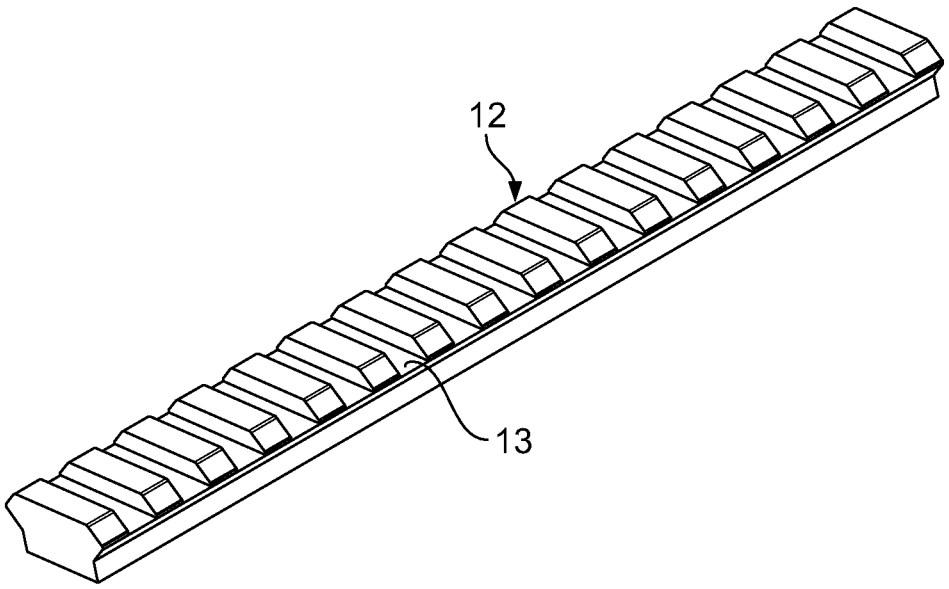
FIG. 2 is a perspective view of a dovetail rail.

Referring now to the drawings, an exemplary embodiment of the invention is generally indicated at 10 in FIGS. 1-14. The invention relates to dovetail rail mounting systems for removably securing a weapon accessory, such as a flashlight to a dovetail rail 12 (FIG. 2). As described above, there are two main types of dovetail attachment rails, the Weaver rail (or universal rail) and the newer MIL-STD 1913 rail, both of which have a virtually identical cross-sectional profile. The key difference lies in the placement of the recoil grooves 13 and in the width of the grooves 13. MIL-STD-1913 grooves 13 are 0.206" wide and have a center-to-center width of 0.394". The placement of these grooves 13 has to be consistent in order for it to be a true MIL-STD system. Weaver (universal) system grooves (not illustrated) are 0.180" wide and are not necessarily consistent in a center-to-center measurement from one groove to the next.

The modular dovetail rail clamping assembly 10 includes a body 14 having a longitudinal axis A (FIG. 1) and a planar rail engaging surface 16 extending parallel to the longitudinal axis A. The body 14 may be integrated directly into the housing of an accessory, such as a flashlight as illustrated. In the exemplary embodiment, the body 14 is molded as part of the elongated housing of a flashlight having a light 18 at the head end thereof and switches 20 at the tail end. The longitudinal axis A extends between the head 18 and the tail 20 of the flashlight housing (body) 14.

Alternately, the body 14 may be formed as a separate mount body for receiving and securing a weapon accessory to the dovetail rail 12. When formed as a mount body, the body may include an opposing mount surface contoured to receive the housing of a weapon accessory, which may comprise any of a variety of lights, laser, IR illuminators, sighting devices or magnifiers.

Figure 3:
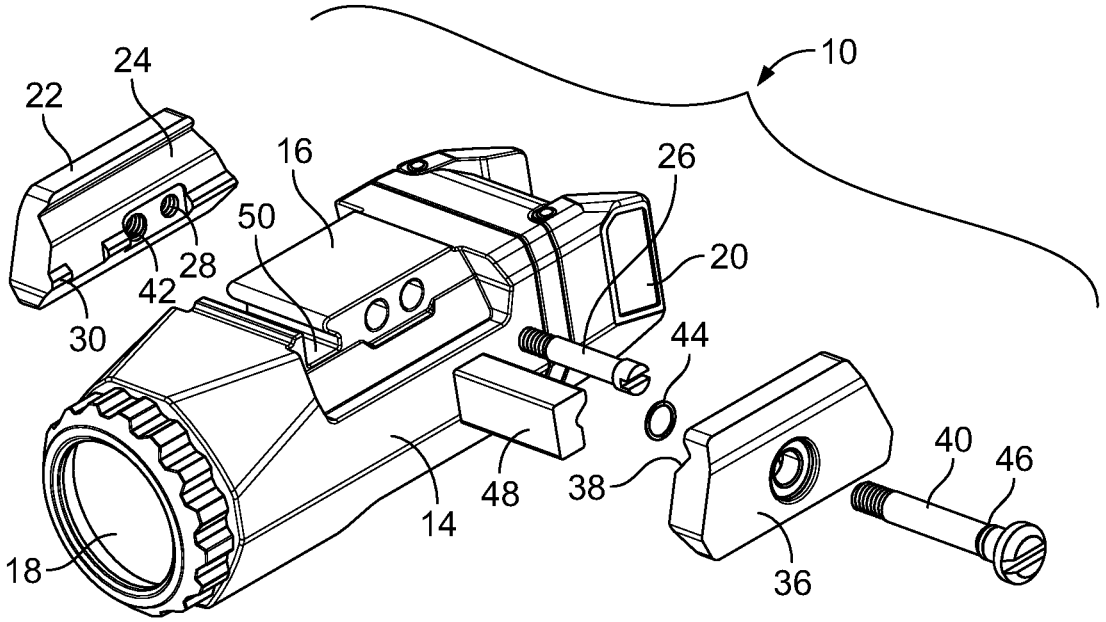
FIG. 3 is an exploded perspective view of the hybrid modular dovetail rail clamp assembly.
Figure 4:
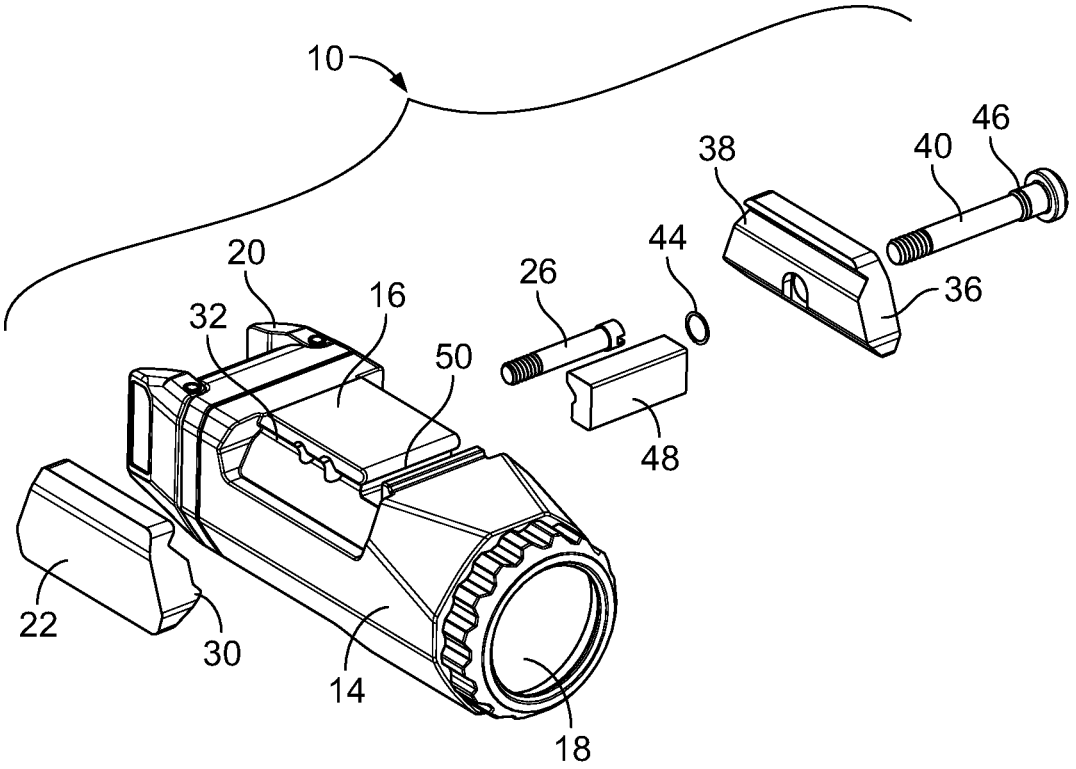
FIG. 4 is another exploded view thereof from a different angle.
Figure 5:
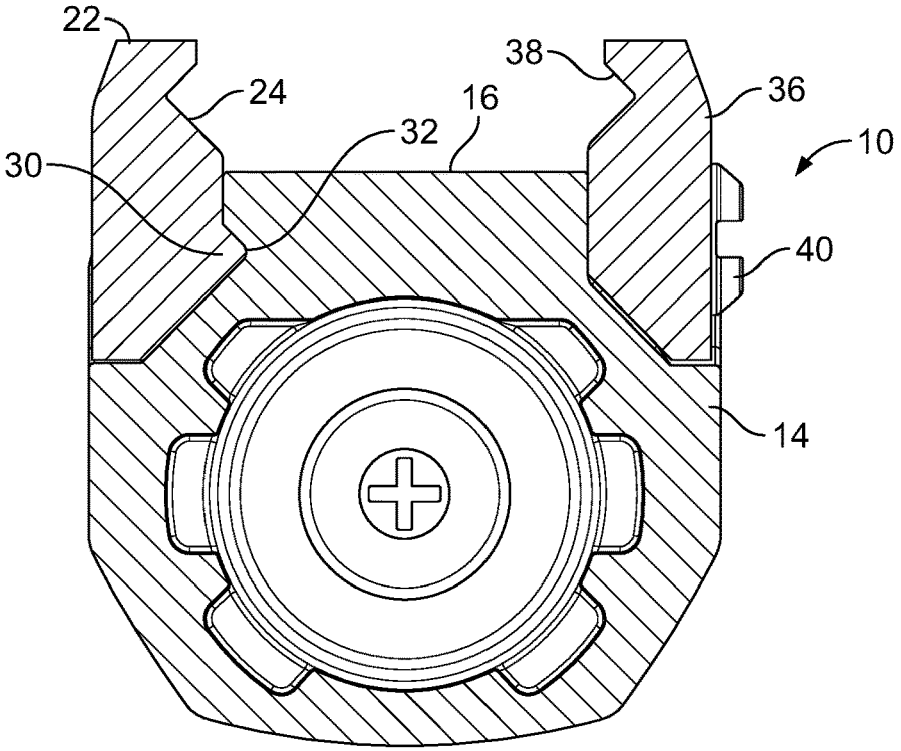
FIG. 5 is a cross-sectional view taken along line 5-5 of FIG. 1.
Figure 6:
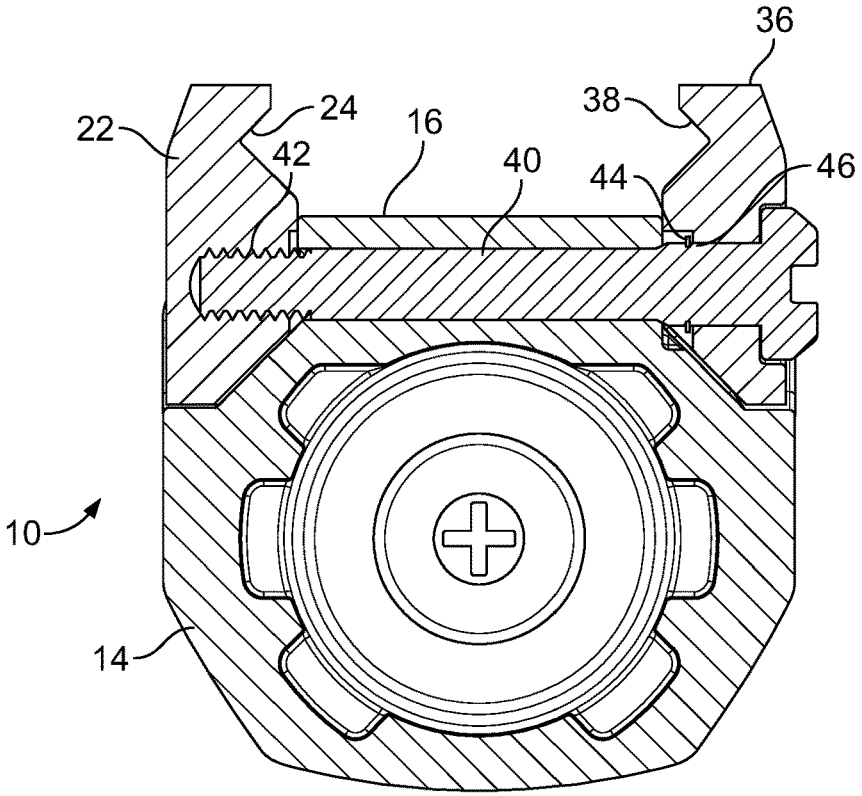
FIG. 6 is another cross-sectional view taken along line 6-6 of FIG. 1.
Figure 7:
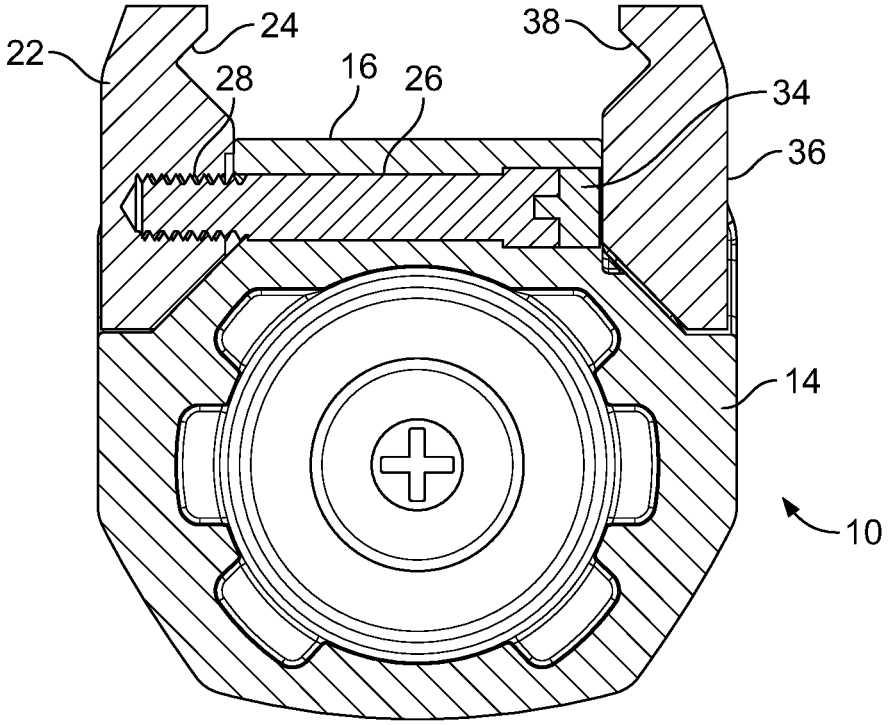
FIG. 7 is still another a cross-sectional view taken along line 7-7 of FIG. 1.

Turning to FIGS. 3 and 4, a fixed clamp component 22 has a longitudinal rail groove 24 for engaging the dovetail rail 12. A first threaded fastener 26 extends transversely through the body 14 and is received into a threaded opening 28 in the fixed clamp component 22 to draw the fixed clamp component 22 into firm engagement with the body 14. Referring briefly to FIG. 5, it can be seen that the fixed clamp component 22 and the body 14 have longitudinal ridge 30 and groove 32 mating structures which rigidly fix alignment of the fixed clamp component 22 relative to the body 14 when assembled. Moving to FIG. 7, the head of the threaded fastener 26 is recessed into the body 14, and in the exemplary embodiments, the threaded fastener 26 is permanently fixed in place with an epoxy plug 34, once the fixed clamp component 22 is assembled with the body.

Turning back to FIGS. 3 and 4, a movable clamp component 36 opposes the fixed clamp component 22 and also has a longitudinal rail groove 38 for engaging the opposing side of the dovetail rail 12. A threaded clamping fastener 40 extends transversely through the movable clamp component 36 and the body 14 and is removably received into a second threaded opening 42 in the fixed clamp component 22 whereby the threaded clamping fastener 40 draws the movable clamp component into engagement with the body (See FIG. 6). The head of the clamping fastener 40 is exposed on the outer surface of the movable clamp component 36 so that the user may remove the fastener 40 when mounting or unmounting the assembly. A snap ring washer 44 is received in a groove 46 in the shank of the fastener 40 to retain the movable clamp component 36 and the fastener 40 together as a unit.

Figure 8:
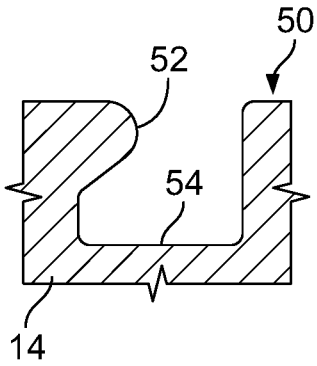
FIG. 8 is a cross-sectional view of the crossbar spline channel.
Figure 9:
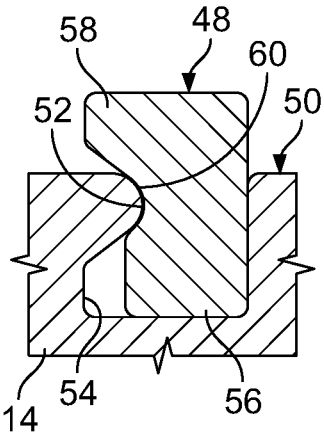
FIG. 9 is a cross-sectional view thereof with the crossbar received therein in a first orientation with the MIL-STD 1913 rail bar side exposed for engagement.
Figure 10:
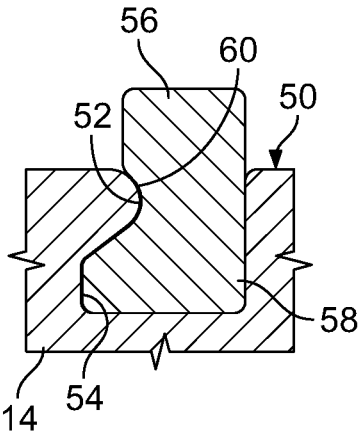
FIG. 10 is another cross-sectional view thereof with the crossbar received therein in a second orientation with the universal rail bar side exposed for engagement.
Figure 11:
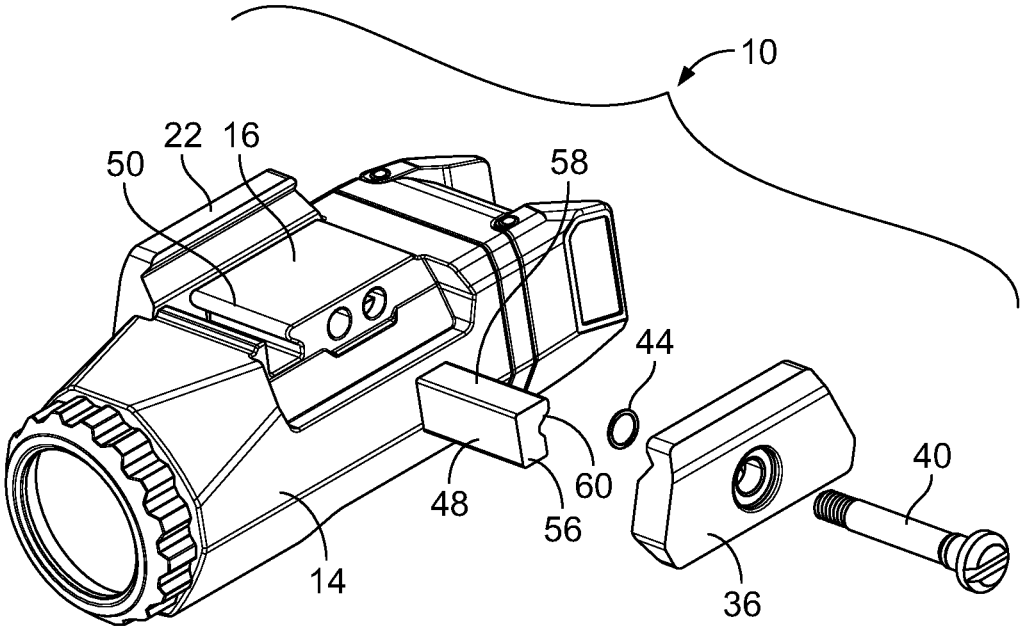
FIGS. 11-12 are exploded assembly views showing assembly of the crossbar in the first orientation with the universal rail bar side received into the spline channel and the MIL-STD 1913 rail bar side exposed for engagement.
Figure 12:
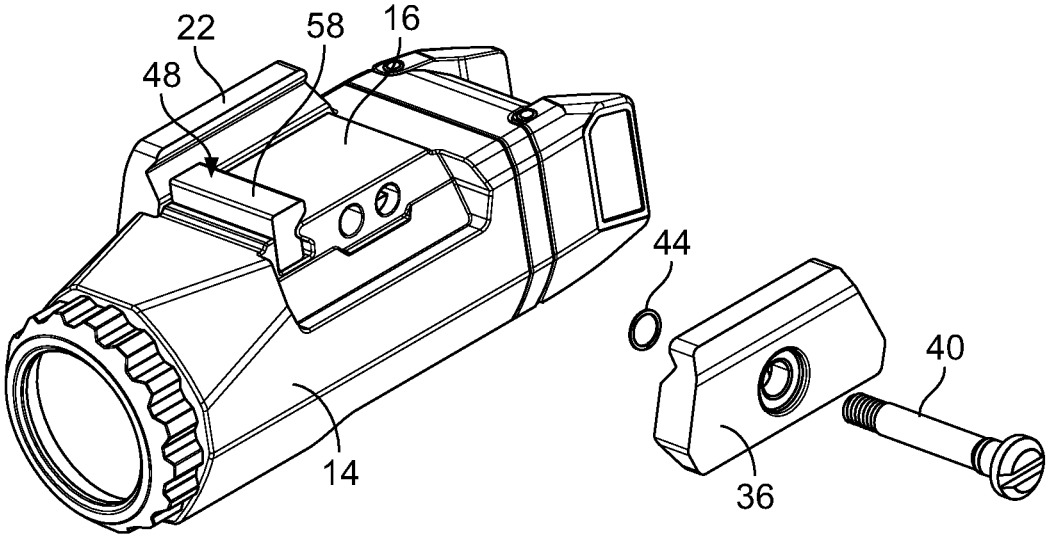
Figure 13:
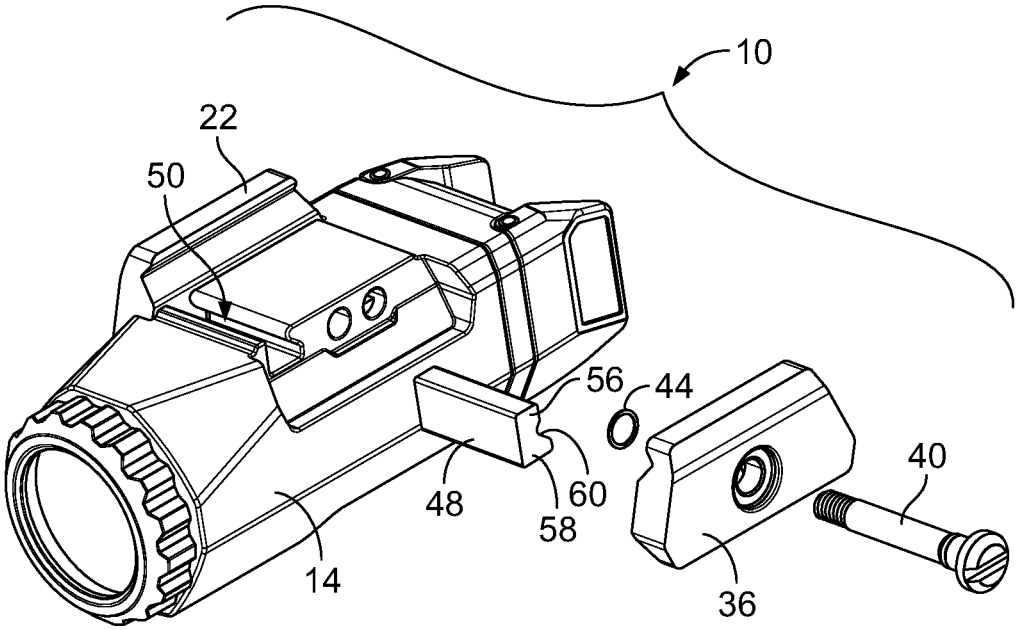
FIGS. 13-14 are exploded assembly views showing assembly of the crossbar in the second orientation with the MIL-STD 1913 rail bar side received into the spline channel and the universal rail bar side exposed for engagement.
Figure 14:
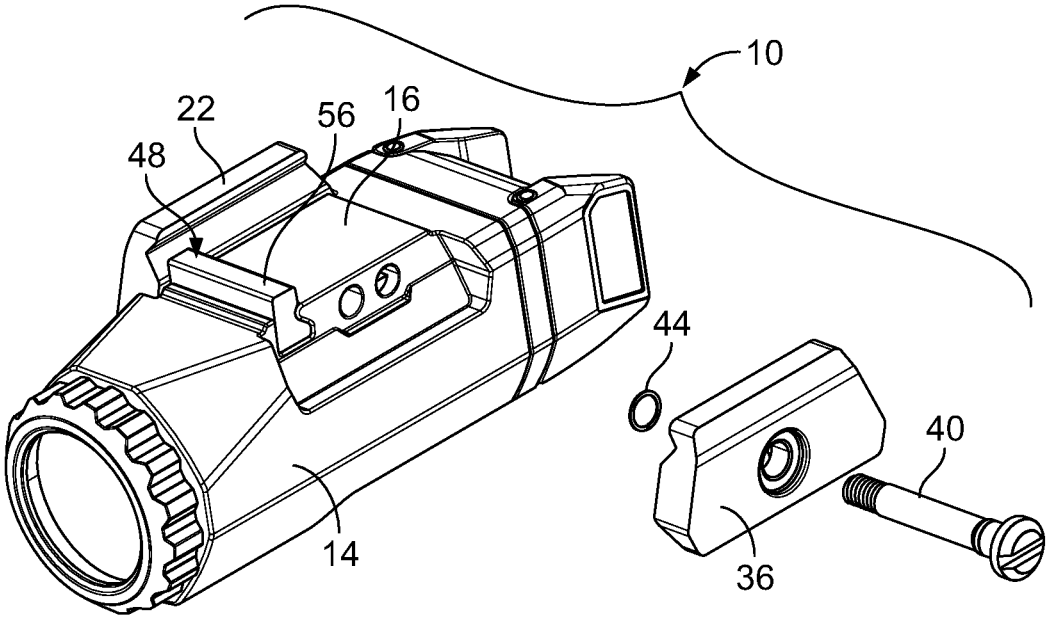

A removable, reversible crossbar 48 extends transversely across the rail engaging surface 16 between the fixed clamp component 22 and the movable clamp component 36. In this regard, the body 14 includes a crossbar spline channel 50 extending transversely through the body 14 and across the rail engaging surface 16. Referring to FIGS. 8-10, the crossbar spline channel 50 has a retaining ridge 52 flush with the rail engaging surface 16 and an angled undercut 54 beneath the retaining ridge 52. The crossbar 48 is formed so that it can be inserted into the spline channel 50 in two different orientations (FIGS. 9 and 10). More specifically, the crossbar 48 has a generally rectangular cross-section with a universal rail bar 56 on one side thereof and a wider MIL-STD 1913 rail bar 58 on an opposing side thereof. A retaining groove 60 which mates with the spline channel retaining ridge 52 is formed on a side surface therebetween.

Turning to FIGS. 11-14, the crossbar 48 can be reversibly mounted in the spline channel 50 wherein the crossbar 48 is slidably received in a first orientation (FIGS. 11-12) within spline channel 50 with the universal rail bar side 56 slidably received in spline channel 50 and the MIL-STD 1913 rail bar side 58 exposed above the rail engaging surface 16 for engagement with the dovetail rail 12 (See also FIG. 9), and a second orientation (FIGS. 13-14) with the MIL-STD 1913 rail bar side 58 slidably received in the spline channel 50 and the universal rail bar side 56 exposed above the rail engaging surface 16 for engagement with the dovetail rail 12 (See also FIG. 10).

Figure 15:
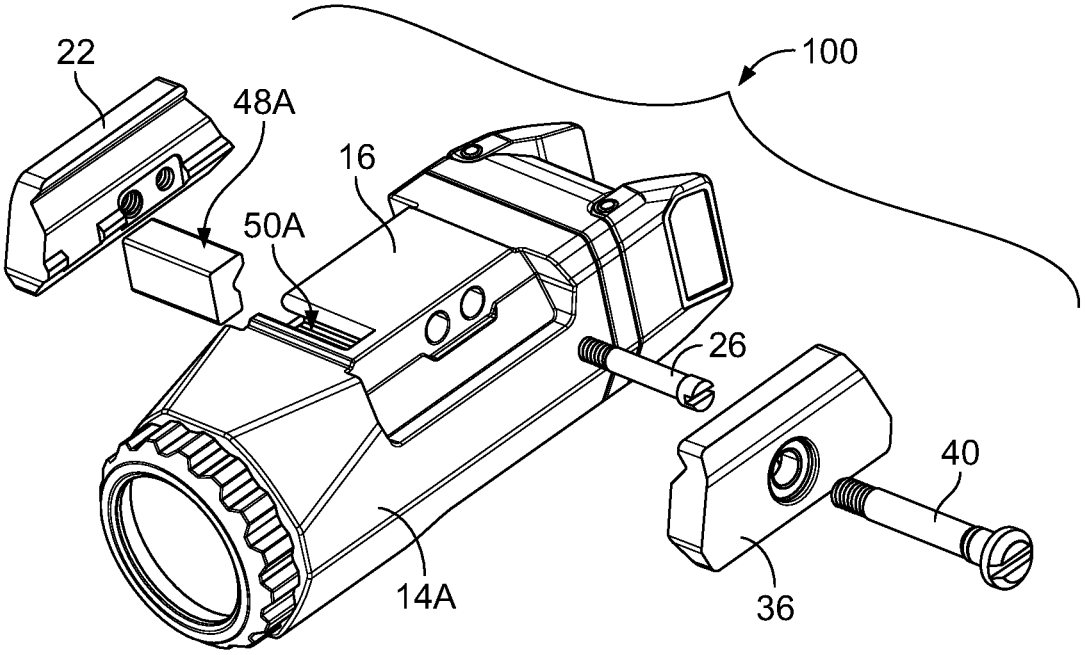
FIG. 15 is an exploded perspective view of another exemplary embodiment of the clamping assembly where the spline channel only partially extends into the body.
Figure 16:
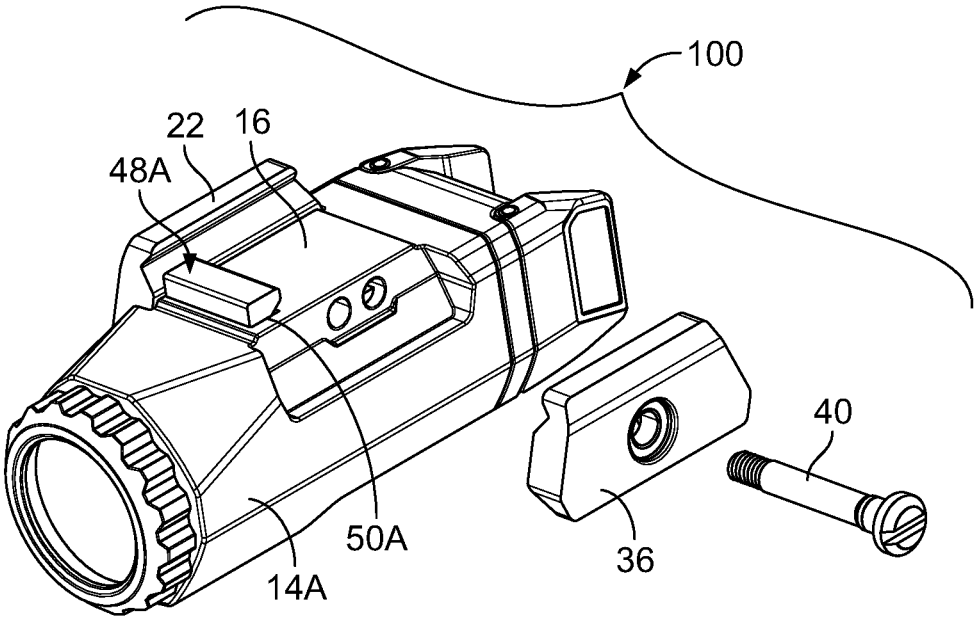
FIG. 16 is a partially assembled view thereof showing the crossbar locking in the channel.
Figure 17:
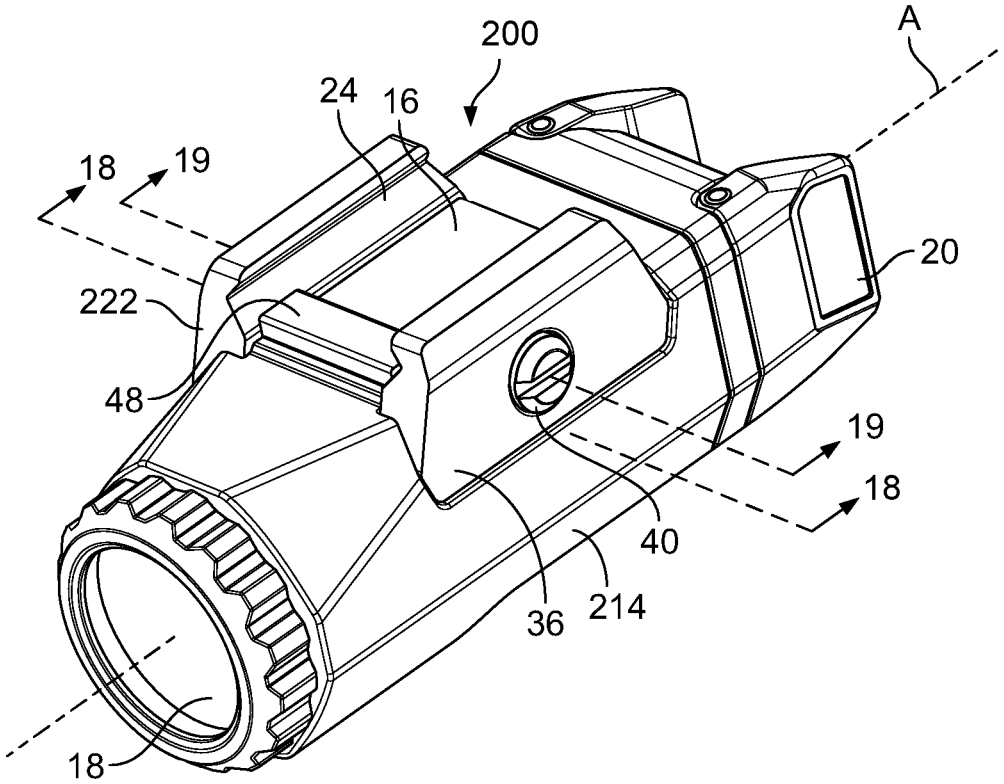
FIG. 17 is a perspective view of another exemplary embodiment of a pistol mounted flashlight incorporating the modular dovetail rail clamping assembly of the present disclosure.
Figure 18:
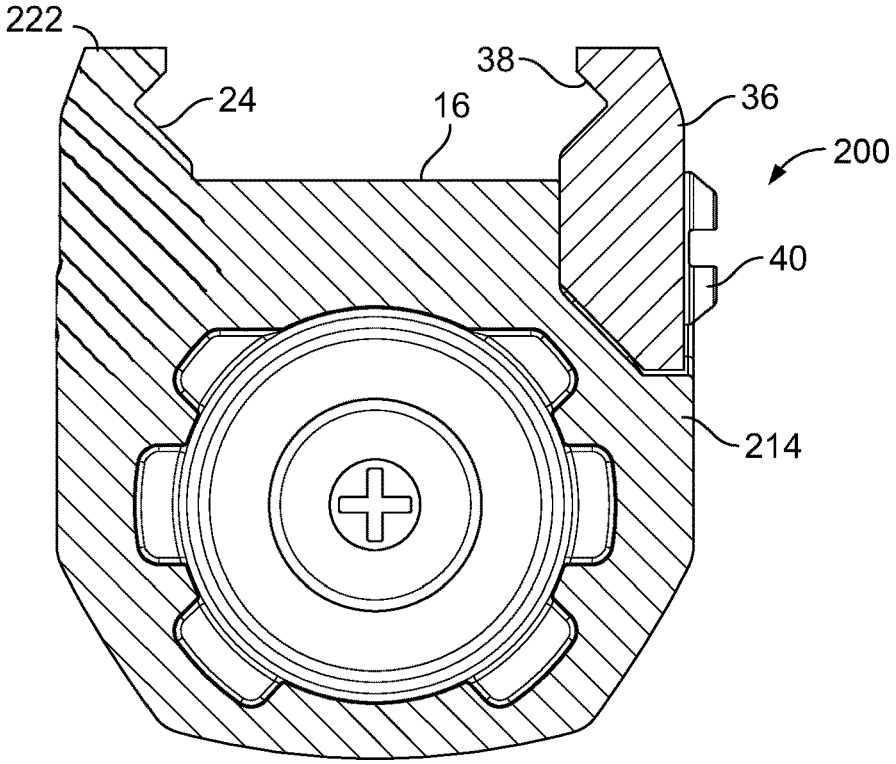
FIG. 18 is a cross-sectional view taken along line 18-18 of FIG. 17.
Figure 19:
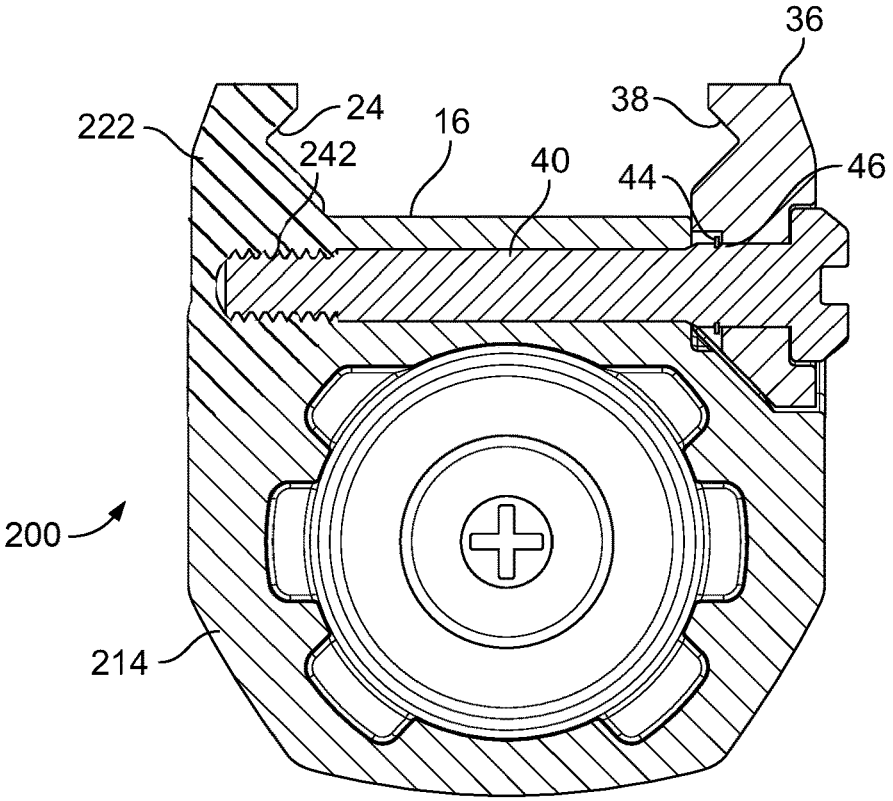
FIG. 19 is another cross-sectional view taken along line 19-19 of FIG. 17.

Referring to FIGS. 15 and 16, another exemplary embodiment is illustrated and generally indicated at 100. In this embodiment, the crossbar spline channel 50A extends only partially inwardly from the fixed clamp component 22 side of the body 14A. The crossbar 48A is made slightly shorter in length and is fully captured between the body 14A and the fixed clamp component 22, rather than the two clamping components 22 and 36. This arrangement provides flexibility in manufacturing to easily provide either of two different dedicated mounting options when the fixed clamp component 22 is secured in place permanently.

In order to provide maximum flexibility in the manufacturing process, the body 14,14A may be molded from a polymer material. This allows the body 14,14A to be molded as a custom mount shape, or directly integrated into the housing of an accessory as described above. In other exemplary embodiments, the crossbar 48, 48A may also be formed from a polymer material. However, to also provide maximum strength and fixation on the dovetail rail 12, the fixed clamp component 22, the moveable clamp component 36, the crossbar 48, 48A and the threaded fasteners 26, 40 are preferably formed from a metal, such as aluminum. This hybrid material arrangement provides the best features from both types of materials.

Referring now to FIGS. 17-21, another exemplary embodiment of the invention is generally indicated at 200.

The modular clamping assembly 200 is in almost all aspects the same as illustrated and described for clamping assembly 10 in FIGS. 1-14. The one noted difference in the construction is an all metal body 214 which includes the integrated formation of the earlier plastic body 14 and metal fixed clamp component 22. In certain embodiments of the flashlight construction it has been shown to be desirable to provide an all metal body construction, but one which can also utilize the reversible crossbar 48.

The modular dovetail rail clamping assembly 200 includes a body 214 having a longitudinal axis A (FIG. 1) and a planar rail engaging surface 16 extending parallel to the longitudinal axis A. The body 214 may be integrated directly into the housing of an accessory, such as a flashlight as illustrated. In the exemplary embodiment, the body 214 is milled as part of the elongated housing of a flashlight having a light 18 at the head end thereof and switches 20 at the tail end. The longitudinal axis A extends between the head 18 and the tail 20 of the flashlight housing (body) 214.

Alternately, the body 214 may be formed as a separate mount body for receiving and securing a weapon accessory to the dovetail rail 12. When formed as a mount body, the body may include an opposing mount surface contoured to receive the housing of a weapon accessory, which may comprise any of a variety of lights, laser, IR illuminators, sighting devices or magnifiers.

Turning to FIGS. 18-21, the fixed clamp component 222 is now milled or otherwise formed as an integrated part of the 214 body and still has a longitudinal rail groove 24 for engaging the dovetail rail 12.

The movable clamp component 36 is the same as previously described and opposes the fixed clamp component 222 and also has a longitudinal rail groove 38 for engaging the opposing side of the dovetail rail 12. Threaded clamping fastener 40 extends transversely through the movable clamp component 36 and into the body 214 and is removably received into a threaded opening 242 (FIG. 19) in the body 214 whereby the threaded clamping fastener 40 draws the movable clamp component into engagement with the body (See also FIG. 19). The head of the clamping fastener 40 is exposed on the outer surface of the movable clamp component 36 so that the user may remove the fastener 40 when mounting or unmounting the assembly. A snap ring washer 44 is received in a groove 46 in the shank of the fastener 40 to retain the movable clamp component 36 and the fastener 40 together as a unit.

Figure 20:
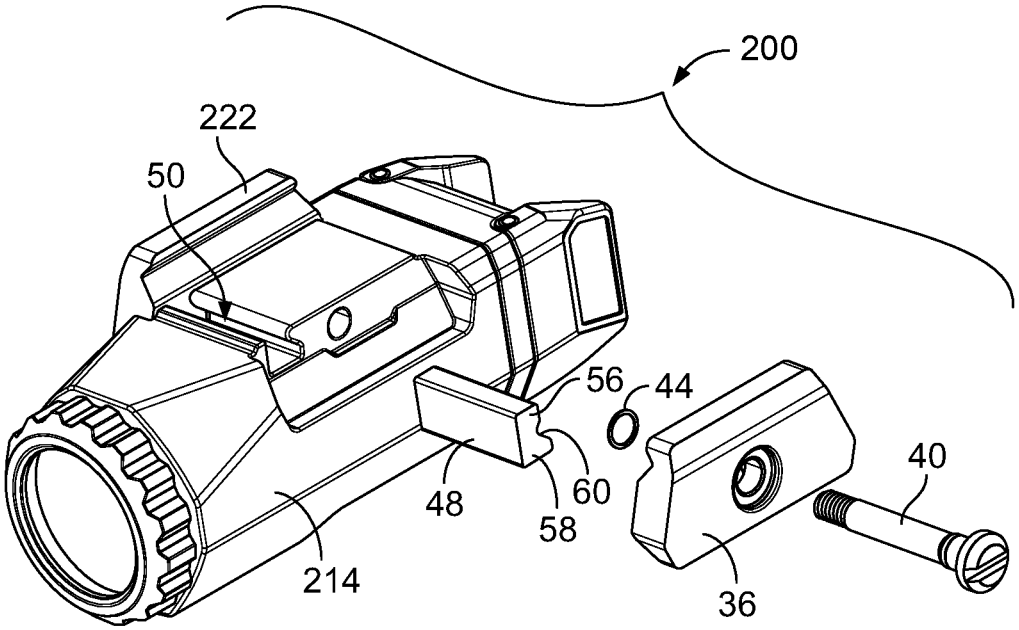
FIGS. 20-21 are exploded assembly views thereof showing assembly of the crossbar in one exemplary orientation with the MIL-STD 1913 rail bar side received into the spline channel and the universal rail bar side exposed for engagement.
Figure 21:
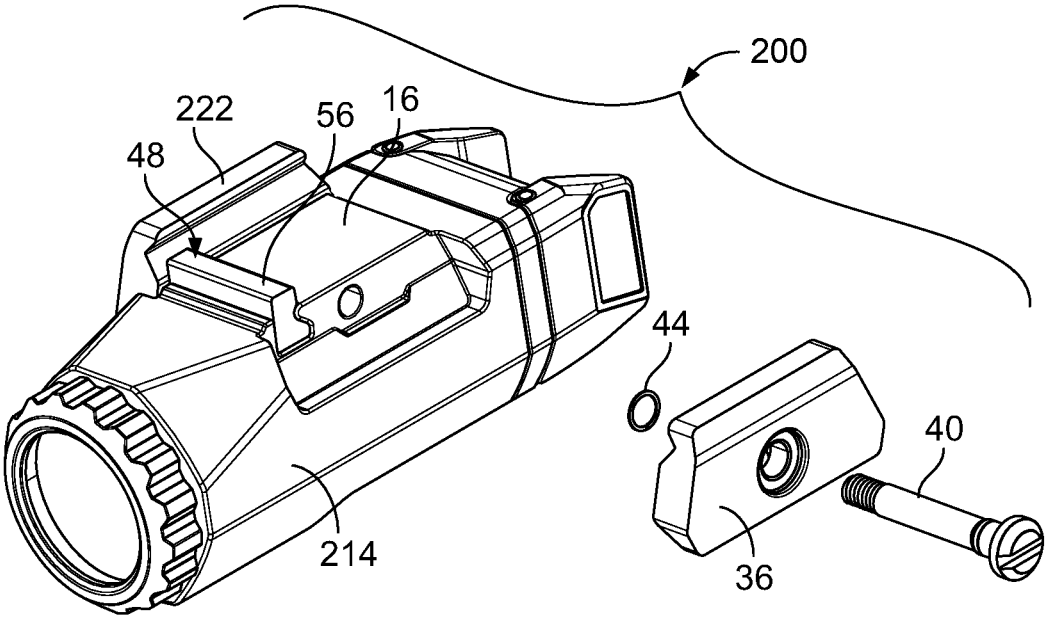

A removable, reversible crossbar 48 as previously described above, extends transversely across the rail engaging surface 16 between the fixed clamp component 222 and the movable clamp component 36. In this regard, the body 214 includes a crossbar spline channel 50 extending transversely across the rail engaging surface 16. Referring to FIGS. 20-21, the crossbar spline channel 50 has a retaining ridge 52 flush with the rail engaging surface 16 and an angled undercut 54 beneath the retaining ridge 52. The crossbar 48 is formed so that it can be inserted into the spline channel 50 in two different orientations (FIGS. 9 and 10). More specifically, the crossbar 48 has a generally rectangular cross-section with a universal rail bar 56 on one side thereof and a wider MIL-STD 1913 rail bar 58 on an opposing side thereof. A retaining groove 60 which mates with the spline channel retaining ridge 52 is formed on a side surface therebetween.

As described above, the crossbar 48 can be reversibly mounted in the spline channel 50 wherein the crossbar 48 is slidably received in the same first and second orientations, i.e. a first orientation within spline channel 50 with the universal rail bar side 56 slidably received in spline channel 50 and the MIL-STD 1913 rail bar side 58 exposed above the rail engaging surface 16 for engagement with the dovetail rail 12 (not shown), and a second orientation (FIGS. 20-21) with the MIL-STD 1913 rail bar side 58 slidably received in the spline channel 50 and the universal rail bar side 56 exposed above the rail engaging surface 16 for engagement with the dovetail rail 12 (See also FIG. 10).

It can therefore be seen that the exemplary embodiments provide unique and novel modular clamping assemblies for any weapon accessory.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims

What is claimed is:

1. A lighting assembly comprising:

an elongated body including a light at one end and at least one switch at an opposing end and a longitudinally extending fixed dovetail rail clamp component;

a transverse spline channel extending into and across said body from a side surface thereof;

a movable dovetail rail clamp component;

a threaded clamping fastener extending through said movable clamp component and threadably received into said body;

a retainer element received on a shank of said threaded clamping fastener, said retainer element configured and arranged to retain said threaded clamping fastener in assembled relation with said movable clamp component; and a removable crossbar slidably received and captured within said spline channel between said fixed clamp component and said movable clamp component, said crossbar having a rail bar extending from the spline channel when received therein.

2. The lighting assembly of claim 1 wherein said rail bar is a universal size rail bar.

3. The lighting assembly of claim 1 wherein said rail bar is a MIL-STD 1913 size rail bar.

4. The lighting assembly of claim 1 wherein said crossbar has a universal size rail bar on one side and a MIL-STD 1913 size rail bar on another side.

5. The lighting assembly of claim 1 wherein said body and said fixed clamp component are integrally formed.

6. The lighting assembly of claim 1 wherein said spline channel has a retaining ridge and an undercut beneath said retaining ridge, said crossbar having a generally rectangular cross-section, said crossbar being slidably received in spline channel with said rail bar exposed for engagement with said dovetail rail.

7. The lighting assembly of claim 6 wherein said rail bar is a universal size rail bar.

8. The lighting assembly of claim 6 wherein said rail bar is a MIL-STD 1913 size rail bar.

9. The lighting assembly of claim 4 wherein said spline channel has a retaining ridge and an undercut beneath said retaining ridge, said crossbar having a generally rectangular cross-section with said universal rail bar on one side thereof and said MIL-STD 1913 rail bar on an opposing side thereof, and a retaining groove on a side surface therebetween, said crossbar being reversible wherein said crossbar is slidably received in a first orientation within said crossbar spline channel with said universal rail bar side slidably received in said spline channel and said MIL-STD 1913 rail bar side exposed for engagement with said dovetail rail, and a second orientation with said MIL-STD 1913 rail bar side slidably received in said spline channel and said universal rail bar side exposed for engagement with said dovetail rail.

10. The lighting assembly of claim 1 wherein said light is selected from the group consisting of: visible lights, lasers and infrared illuminators.

11. The lighting assembly of claim 4 wherein said light is selected from the group consisting of: visible lights, lasers and infrared illuminators.

12. The lighting assembly of claim 6 wherein said light is selected from the group consisting of: visible lights, lasers and infrared illuminators.

13. The lighting assembly of claim 9 wherein said light is selected from the group consisting of: visible lights, lasers and infrared illuminators.

14. The lighting assembly of claim 1 wherein said retainer element comprises a snap ring received in a groove adjacent a head portion of said threaded fastening element.

15. The lighting assembly of claim 4 wherein said retainer element comprises a snap ring received in a groove adjacent a head portion of said threaded fastening element.

16. The lighting assembly of claim 6 wherein said retainer element comprises a snap ring received in a groove adjacent a head portion of said threaded fastening element.

17. The lighting assembly of claim 9 wherein said retainer element comprises a snap ring received in a groove adjacent a head portion of said threaded fastening element.

18. The lighting assembly of claim 1 wherein said at least one switch comprises a pair of opposing switches.

19. The lighting assembly of claim 4 wherein said at least one switch comprises a pair of opposing switches.

20. The lighting assembly of claim 6 wherein said at least one switch comprises a pair of opposing switches.

* * * * *